US012392559B2

(12) United States Patent
Jao

(10) Patent No.: US 12,392,559 B2
(45) Date of Patent: Aug. 19, 2025

(54) FLEXIBLE VAPOR CHAMBER

(71) Applicant: FORCECON TECHNOLOGY CO., LTD., Zhubei (TW)

(72) Inventor: Chen-Chi Jao, Toufen (TW)

( * ) Notice: Subject to any disclaimer, the term of this patent is extended or adjusted under 35 U.S.C. 154(b) by 147 days.

(21) Appl. No.: 18/501,538

(22) Filed: Nov. 3, 2023

(65) Prior Publication Data

US 2025/0146761 A1 May 8, 2025

(51) Int. Cl.
*F28D 15/02* (2006.01)
*F28D 15/04* (2006.01)

(52) U.S. Cl.
CPC ..... *F28D 15/0241* (2013.01); *F28D 15/046* (2013.01)

(58) Field of Classification Search
CPC ..... F28D 15/0241; F28D 15/046
See application file for complete search history.

(56) References Cited

U.S. PATENT DOCUMENTS 6,446,706 B1 * 9/2002 Rosenfeld ..... F28D 15/046 165/905
2009/0071632 A1 * 3/2009 Bryant ..... F28D 15/04 165/104.26
2019/0124791 A1 * 4/2019 Hsiao ..... F28D 15/025
2020/0049420 A1 * 2/2020 Liu ..... F28D 15/04
2020/0326134 A1 * 10/2020 Chen ..... H01L 23/427
2023/0204301 A1 * 6/2023 Mao ..... F28D 15/0241 165/104.26
2023/0204302 A1 * 6/2023 Mao ..... F28D 15/0275 165/104.26

FOREIGN PATENT DOCUMENTS

KR 20180116609 A * 10/2018

* cited by examiner

*Primary Examiner* — Tho V Duong
(74) *Attorney, Agent, or Firm* — Egbert, McDaniel & Swartz, PLLC

(57) ABSTRACT

Disclosed is a flexible vapor chamber having two flexible enclosures and a wick structure. A chamber is formed between the flexible enclosures, which accommodates a working fluid designed to absorb and dissipate heat. In addition, the wick structure is disposed within the chamber. Each of the flexible enclosures has a flexible section and two extensions in a length direction, and each of the flexible sections is located between the extensions that constitute the flexible enclosures and extends to both opposite sides of the flexible enclosures in a width direction. The thickness of each flexible section is thinner than that of each adjacent extension, and the design allows each flexible enclosure to be flexibly bent in a direction of its thickness.

8 Claims, 9 Drawing Sheets

FLEXIBLE VAPOR CHAMBER

CROSS-REFERENCE TO RELATED U.S. APPLICATIONS

Not applicable.

BACKGROUND OF THE INVENTION

1. Field of the Invention

The present invention relates to a thin heat sink device, and in particular to a flexible thin vapor chamber.

2. Description of Related Art Including Information Disclosed Under 37 CFR 1.97 and 37 CFR 1.98

A thin vapor chamber is a heat sink device applied to electronic equipment, including a base plate and a cover plate connected to each other. A chamber is formed between the base plate and the cover plate, and the chamber internally accommodates a working fluid and a wick structure, wherein the working fluid serves the purpose of absorbing and dissipating heat, while the wick structure guides the flow of the working fluid and divides the chamber into multiple wick spaces. The base and cover plates are constructed of different layers. Specifically, they consist of a heat-conducting film, a polymer film, and an outer film. The polymer film is sandwiched between a metal film and a protective film, and the heat-conducting film on both the base plate and the cover plate is positioned on a side facing the chamber.

The wick structure directs the flow direction of the working fluid, and with the phase change that occurs as the working fluid absorbs and dissipates heat, enables rapid and substantial heat absorption, while also accelerating heat dissipation, ultimately leading to the maintenance of a stable operating temperature.

During the operation of electronic devices such as cell phones, tablets, laptops, and others generates a significant amount of heat from various components, including processors, batteries, and antennas. Often, these electronic devices simultaneously integrate multiple components that generate heat, resulting in an internal heat source generated within the device. To effectively address this thermal challenge, the use of thin vapor chambers for heat-sensitive components such as processors, batteries, and antennas is a strategic choice. Each thin vapor chamber efficiently and uniformly disperses the heat generated by these electronic components, reducing the risk of overheating and ensuring optimal electronic device performance and reliability.

In certain portable electronic devices, including foldable designs that prioritize portability or adaptability to different configurations, face a challenge when integrating thin vapor chambers that use rigid materials for the base and cover plates. These inflexible vapor chambers cannot seamlessly accommodate the bending and deformation required by the foldable components of the electronic device. As a result, electronic components and circuit units that require the use of the thin vapor chamber face limitations that restrict their placement to non-foldable areas of the device. This limitation has a significant impact on the overall space efficiency and configuration capabilities of the electronic device.

BRIEF SUMMARY OF THE INVENTION

The main purpose of the present invention is to introduce a flexible vapor chamber.

In light of the foregoing purpose, the technical features of the present invention for solving the problem are mainly as follows.

A flexible vapor chamber comprises two flexible enclosures and a wick structure, wherein each of the flexible enclosures is a flat and thin structure having a width and a length. Each of the flexible enclosures is opposed to each other in a thickness direction, and each of the flexible enclosures is combined to form a sealing edge structure, and a chamber is formed between each of the flexible enclosures and the sealing edge structure. The interior of the chamber accommodates a working fluid, which is used to absorb and dissipate heat, and the wick structure is disposed in the chamber and divides the chamber to form multiple wick spaces which are used to direct the flow direction of the working fluid.

Each of the flexible enclosures is a layered structure that is flexibly bent in the thickness direction, and each of the flexible enclosures comprises a first metal film, a flexible polymer film, and two second metal films, wherein the first metal film is positioned on a side of each of the flexible enclosures facing the chamber in the thickness direction, and each of the second metal films is positioned on a side of each of the flexible enclosures away from the chamber in the thickness direction, and the polymer film is positioned between the first metal film and the second metal film.

The flexible enclosure is formed with a flexible section and two extensions along a length direction, wherein each of the flexible sections is located between each of the extensions that constitute each of the flexible enclosures, and each of the flexible sections extends to opposite sides of each of the flexible enclosures in a width direction. The thickness of each of the flexible sections is thinner than the thickness of its adjacent connected extensions, whereby each of the flexible enclosures is flexibly bent in the thickness direction.

The configuration density of the wick structure at the part corresponding to each of the flexible sections is smaller than the configuration density at the part corresponding to each of the extensions.

Each of the flexible enclosures can be flexibly bent along the thickness direction, centered on each flexible section in the length direction. In the context of the foldable electronic device, this flexibility enables the selection of electronic components and circuit units that require heat dissipation to be positioned in both foldable and non-foldable regions of the device. This strategic placement optimizes the overall space utilization and increases the efficiency of the electronic device configuration.

DETAILED DESCRIPTION OF THE INVENTION

Figure 1:
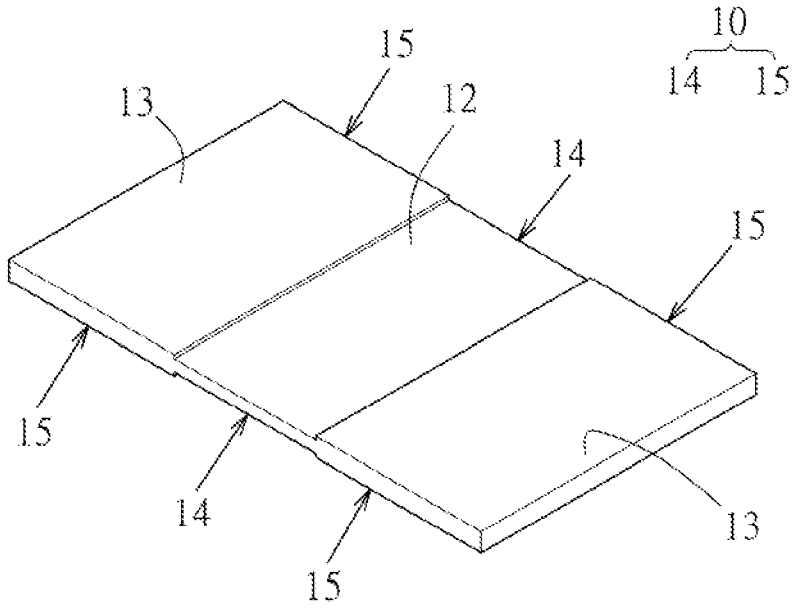
FIG. 1 is a three-dimensional view of Embodiment 1 of the present invention.
Figure 2:
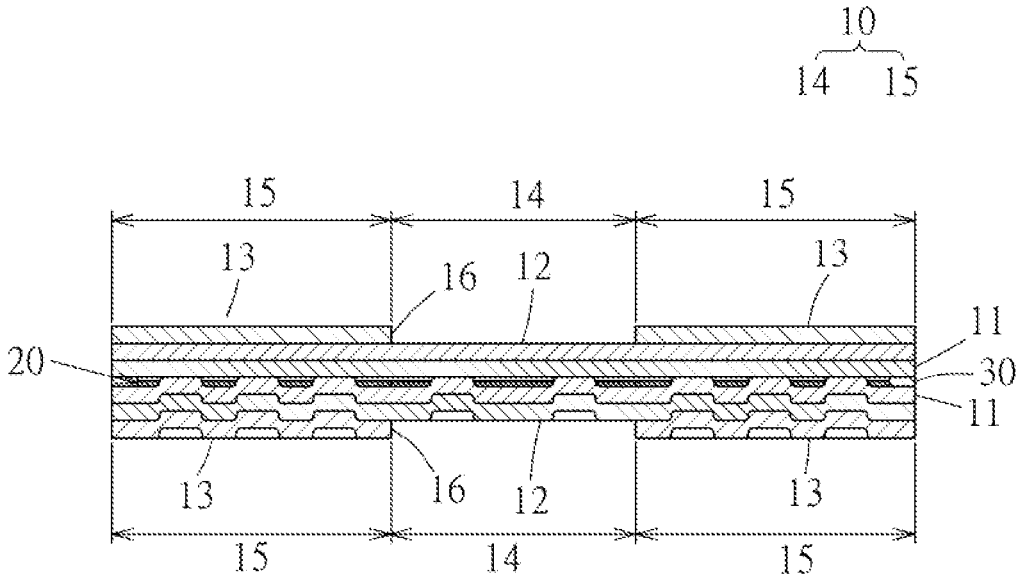
FIG. 2 is a cross-sectional view of Embodiment 1 of the present invention along the length direction.
Figure 3:
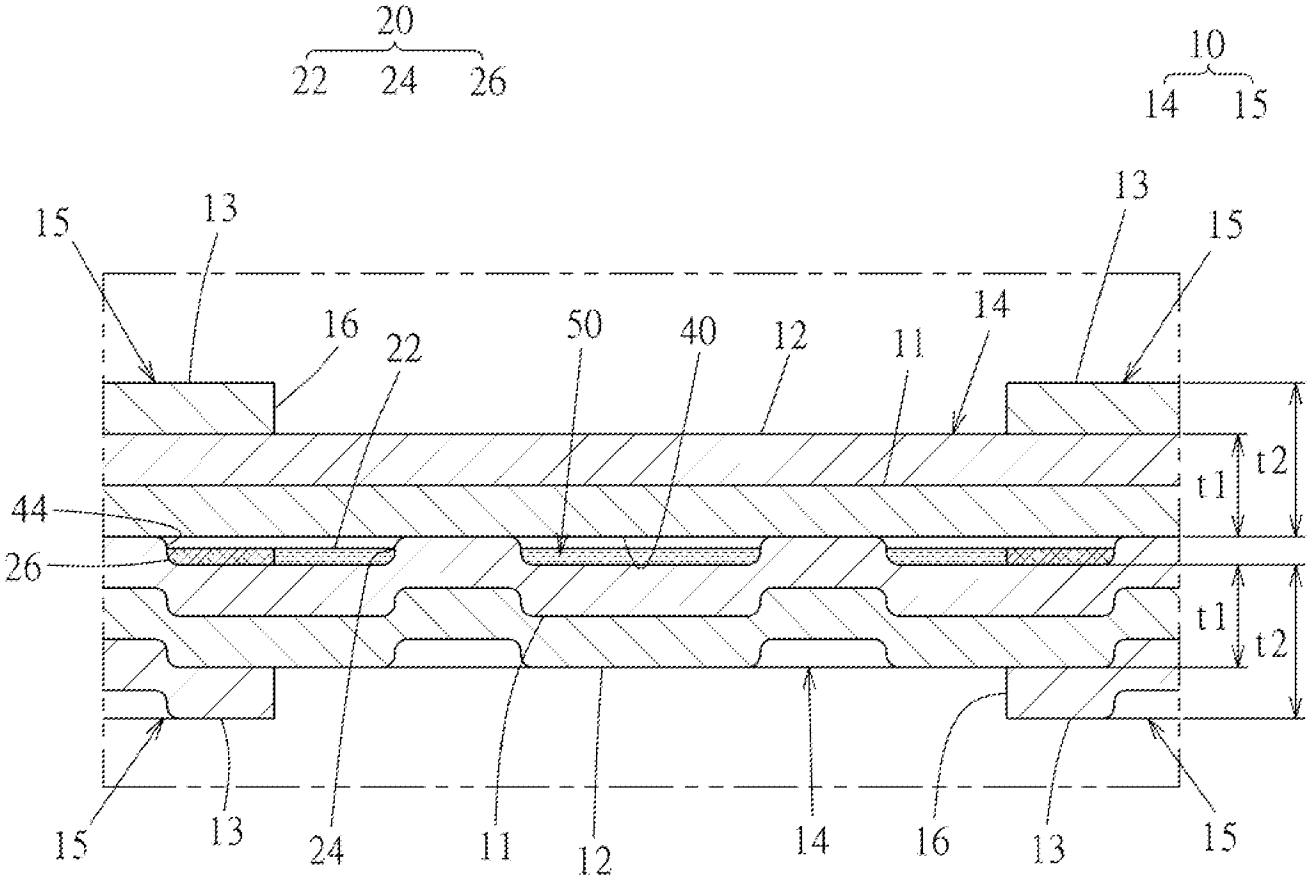
FIG. 3 is a partially enlarged view of FIG. 2.
Figure 4:
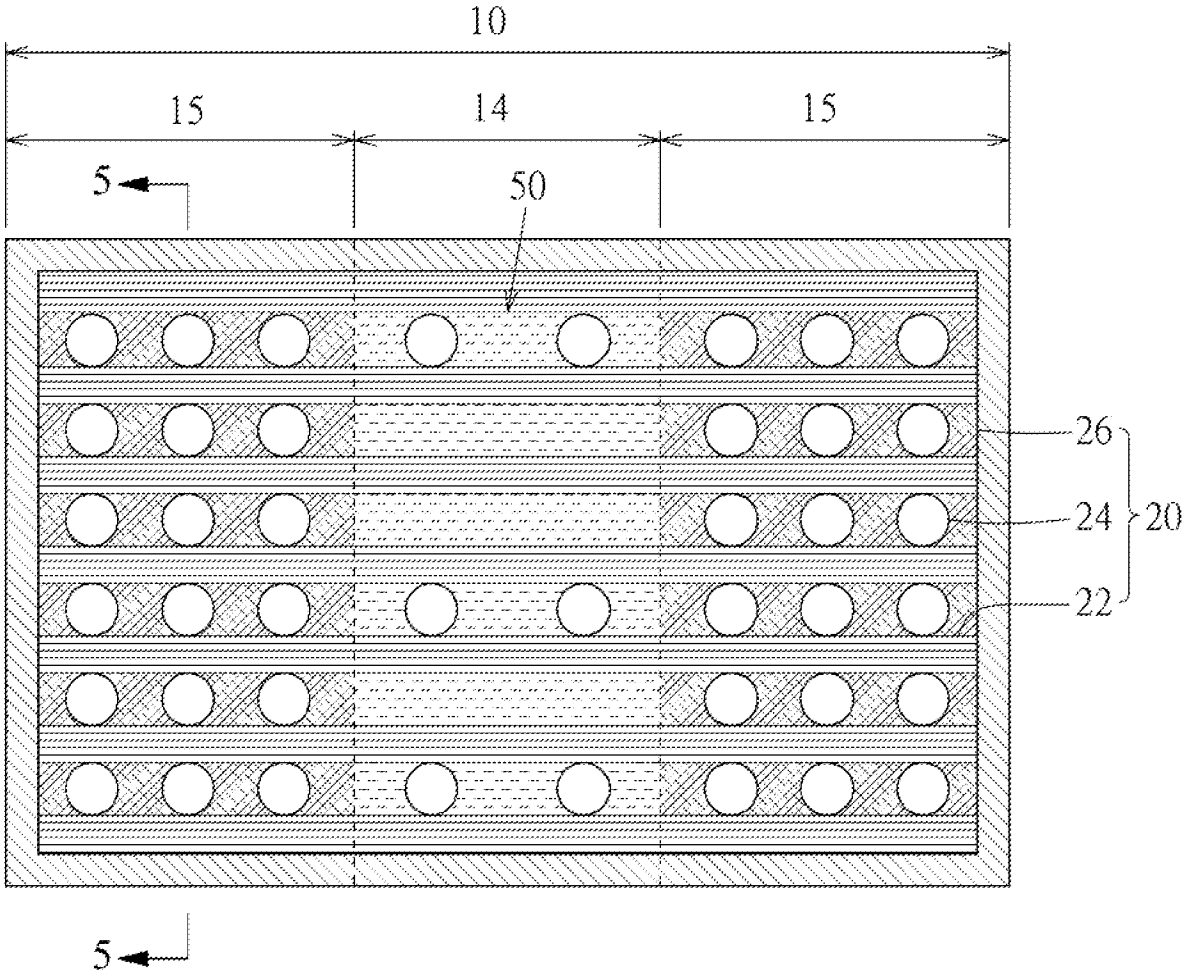
FIG. 4 is a cross-sectional view of Embodiment 1 of the present invention.
Figure 5:
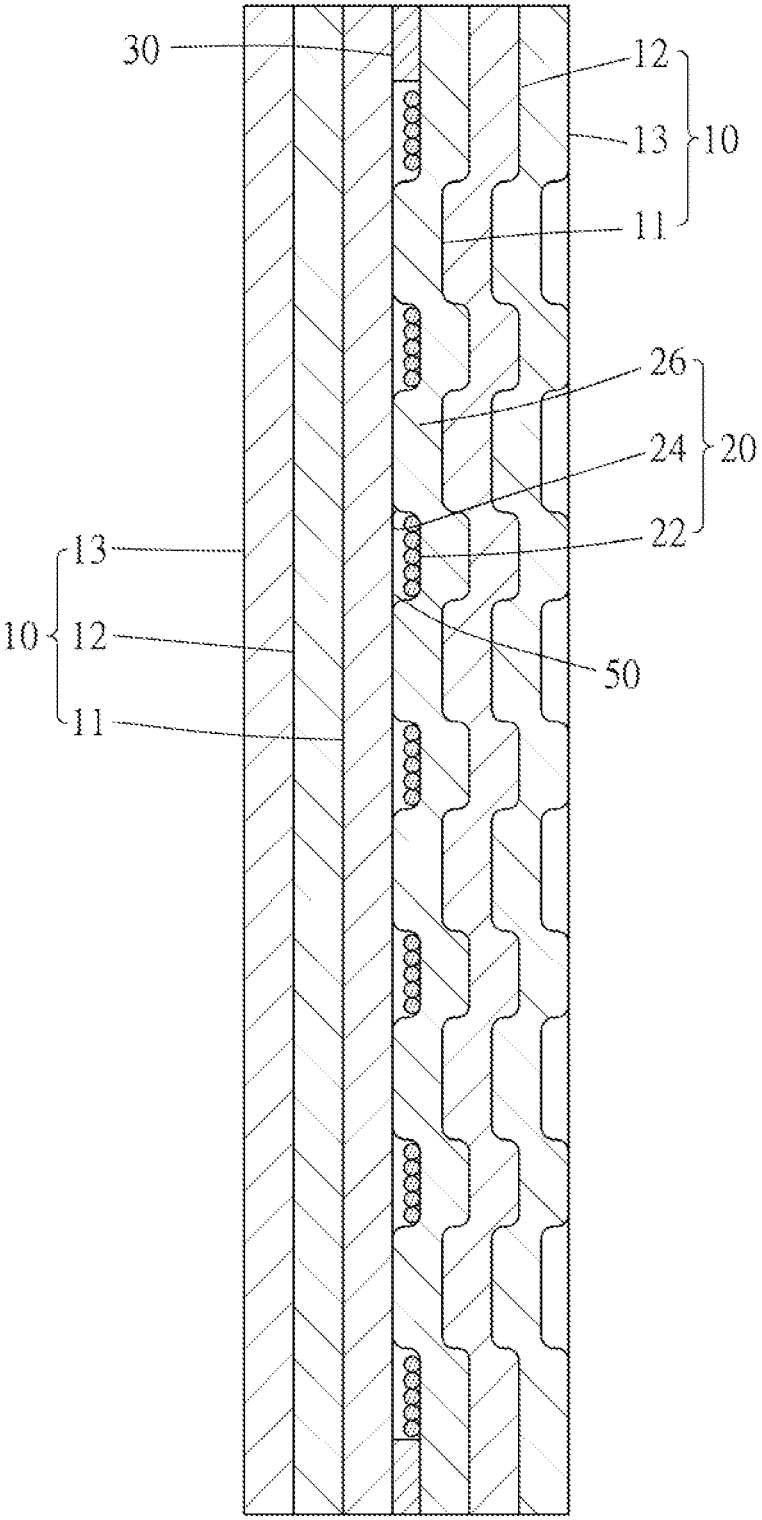
FIG. 5 is a 5-5 cross-sectional view of FIG. 4.
Figure 6:
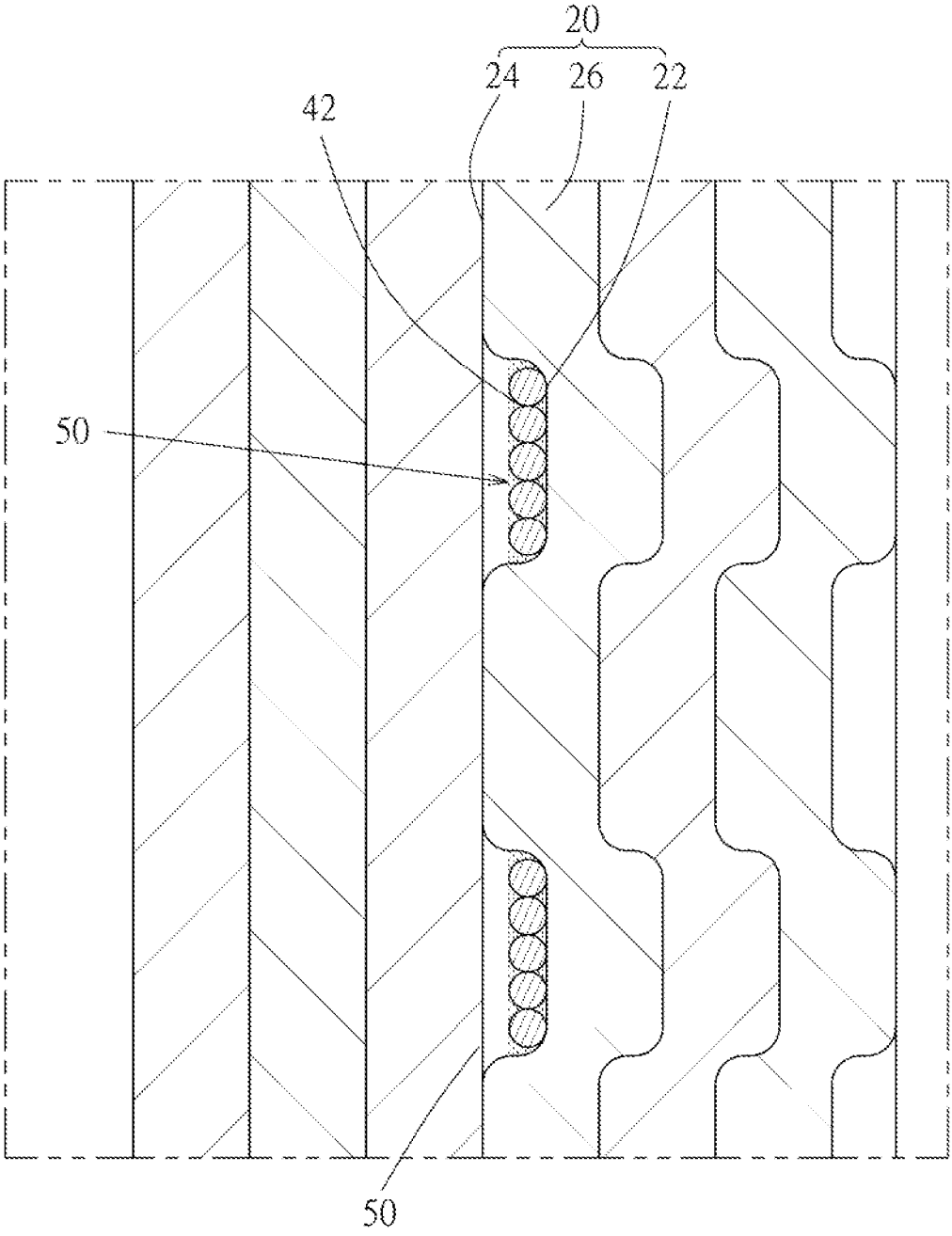
FIG. 6 is a partially enlarged view of FIG. 5.
Figure 7:
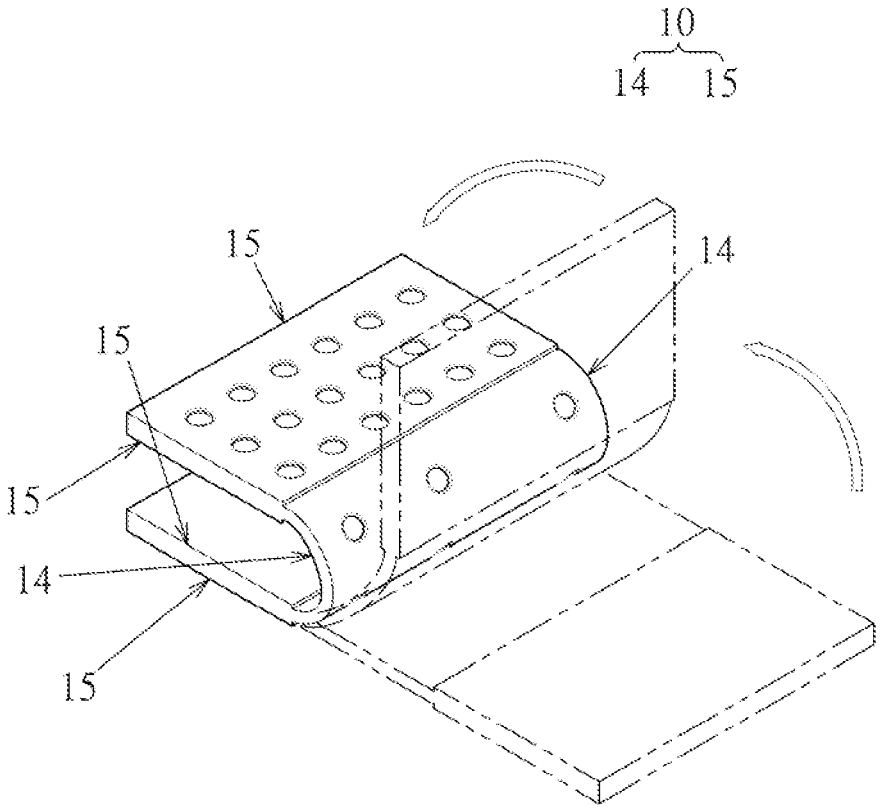
FIG. 7 is a three-dimensional schematic diagram in a bending state of Embodiment 1 of the present invention.

Reference is made to the drawings which show embodiments of a flexible vapor chamber of the present invention, but these embodiments are for illustrative purposes only and are not subject to the limitations of this structure in a patent application.

As shown in FIGS. 1 to 7, Embodiment 1 of the flexible vapor chamber comprises two flexible enclosures 10 and a wick structure 20, wherein each of the flexible enclosures 10 is a flat and thin structure having a width and a length. Each of the flexible enclosures 10 is opposed to each other in a thickness direction, and each of the flexible enclosures 10 is combined to form a sealing edge structure 30, and a chamber 40 is formed between each of the flexible enclosures 10 and the sealing edge structure 30. The interior of the chamber 40 accommodates a working fluid 50, which is used to absorb and dissipate heat, and the wick structure 20 is disposed in the chamber 40 and divides the chamber 40 to form multiple first wick spaces 42 and multiple second wick spaces 44, each of which is used to direct the flow direction of the working fluid 50, whereby the working fluid 50 can generate a phase change when absorbing and dissipating heat and can rapidly and substantially absorb heat and accelerate heat dissipation, ultimately resulting in maintaining a stable operating temperature.

Each of the flexible enclosures 10 is a layered structure that can be flexibly bent in the thickness direction, and each of the flexible enclosures 10 comprises a first metal film 11, a flexible polymer film 12, and two second metal films 13, wherein the first metal film 11 is positioned on a side of each of the flexible enclosures 10 facing the chamber 40 in the thickness direction, and each of the second metal films 13 is positioned on a side of each of the flexible enclosures 10 away from the chamber 40 in the thickness direction, and the polymer film 12 is positioned between the first metal film 11 and the second metal film 13.

The flexible enclosure 10 is formed with a flexible section 14 and two extensions 15 along a length direction, wherein each of the flexible sections 14 is located between each of the extensions 15 that constitute each of the flexible enclosures 10, and each of the flexible sections 14 extends to opposite sides of each of the flexible enclosures 10 in a width direction. The thickness t1 of each of the flexible sections 14 is thinner than the thickness t2 of its adjacent connected extensions 15, whereby each of the flexible enclosures 10 can be flexibly bent in the thickness direction.

Using the thickness t1 of the flexible section 14, which is thinner than the thickness t2 of each of the extensions 15 connected adjacent thereto, together with each of the flexible enclosures 10 that is formed by the stacking of the first metal film 11, the polymer film 12, and the second metal films 13, each of the flexible enclosures 10 can be flexibly bent in the thickness direction centered on each of the flexible sections 14, and can enable the extensions 15 located on two sides of the flexible section 14 to close relatively to each other in the length direction, thereby facilitating bending and deformation that can be aligned with the folding portion of the foldable electronic device. For the electronic components and circuit units of the electronic device that require heat dissipation, then it can be optionally configured at the either the foldable or non-foldable region of the electronic device, thereby increasing the efficiency of the overall configuration of the electronic device in terms of the space utilization.

Each of the first metal films 11 of each flexible enclosure 10 opposed to each other optionally forms the sealing edge structure 30 by a low-temperature hot-melting means at 170° C. to 350° C., and each of the first metal films 11 opposed to each other may also optionally form the sealing edge structure 30 by a sintering means at 250° C. to 300° C.

The sealing edge structure 30 optionally surrounds a lateral periphery of the chamber 40 such that each of the flexible enclosures 10 can cooperate with the sealing edge structure 30 to seal the chamber 40.

Each of the flexible enclosures 10 optionally forms a recess 16 on a side of the flexible enclosure 10 that is away from the chamber 40 in the thickness direction. Within each of these flexible enclosures 10, each of the flexible sections 14 constitutes a side of the recess 16 facing the chamber 40. In addition, each of the extensions 15 is formed on the opposite sides of the recess 16 in the length direction of each flexible enclosure 10, and each of the recesses 16 extends across the opposite sides of each flexible enclosure 10 in the width direction so that the thickness t1 of each of the flexible sections 14 is thinner than the thickness t2 of each of the extensions 15 that are connected adjacent thereto.

Each of the flexible enclosures 10 is optionally configured with two of the second metal films 13 spaced apart in the length direction, each of the second metal films 13 constituting two opposite sides of each of the recesses 16, and each of the polymer films 12 constituting a side of each of the recesses 16 facing the chamber 40.

The wick structure 20 comprises multiple copper wires 22, multiple copper rods 24, and multiple meshes 26, wherein each of the copper wires 22 is axially parallel to each other and arranged in bundles, and each of the copper wires 22 extends axially from the flexible section 14 corresponding to the chamber 40 to the extensions 15 corresponding to the chamber 40 on both sides. A narrow length of each of those first wick spaces 42 is formed between each of those radially adjacent copper wires 22, and each of those first wick spaces 42 is parallel to each of those copper wires 22, thereby directing the flow direction of the working fluid 50. A selected one of the first metal films 11 is formed on a side facing the chamber 40 with each of the copper rods 24, and each of the copper rods 24 is connected to another one of the first metal films 11. Each of the meshes 26 is configured between each of the adjacent copper rods 24, thereby forming the second wick spaces 44 communicating with the adjacent first wick spaces 42.

Along the thickness direction of each of the flexible enclosures 10, the configuration density of each of the copper rods 24 at the part corresponding to each of the flexible sections 14 is smaller than the configuration density at the part corresponding to each of the extensions 15. Each of the meshes 26 is configured at the part corresponding to each of the extensions 15, while the part corresponding to the flexible sections 14 is not configured with the meshes 26 so that the configuration density of the wick structure 20 at the part corresponding to each of the flexible sections 14 is smaller than the configuration density at the part corresponding to each of the extensions 15. Accordingly, the bending characteristics of each of the flexible sections 14 in Embodiment 1 are superior to those of each of the extensions 15. In addition, each of the copper rods 24 is optionally stamped and molded from the first metal film 11.

Furthermore, the Embodiment 1 may optionally form multiple copper rods 24 in each of those first metal films 11, connecting each of those copper rods 24 opposite to each other in the thickness direction of each of the flexible enclosures 10, thereby constituting a variant embodiment option based on the variations of the Embodiment 1.

Each of the first metal films 11 and each of the second metal films 13 is a heat-conducting metal composition, wherein the heat-conducting metal is selected from any one of gold, silver, copper, aluminum, iron, stainless steel, and copper alloy, and each of the first metal films 11 and each of the second metal films 13 may be selected from the same material or different material compositions. In Embodiment 1, the copper is selected as the material for each of the first metal films 11 and each of the second metal films 13.

Each of the polymer films 12 is selected from any one of polypropylene, polyethylene, polystyrene, polyamide-imide, modified polyamide-imide, polyethylene dibenzoate, and liquid crystal polymer, and each of the polymer films 12 may be selected from the same material or different material compositions. In Embodiment 1, the polyamide-imide is selected as the material for each of the polymer films 12.

Figure 8:
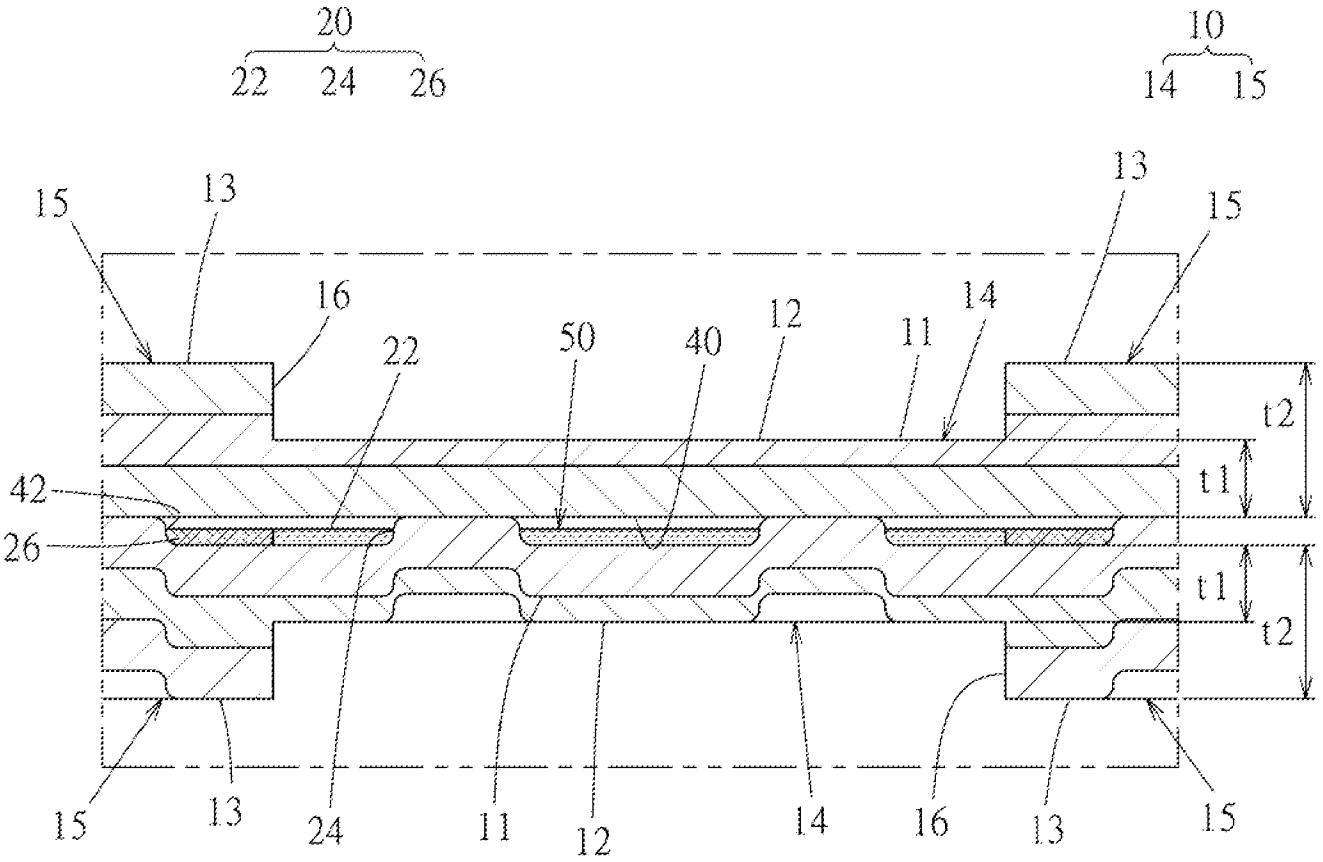
FIG. 8 is a partially enlarged cross-sectional view of Embodiment 2 of the present invention.

As shown in FIG. 8, Embodiment 2 differs from Embodiment 1 primarily in that each of the recesses 16 enters each of the polymer films 12 in the direction of the chamber 40 so that each of the polymer films 12 constitutes a part of both opposite sides of each of the recesses 16.

Figure 9:
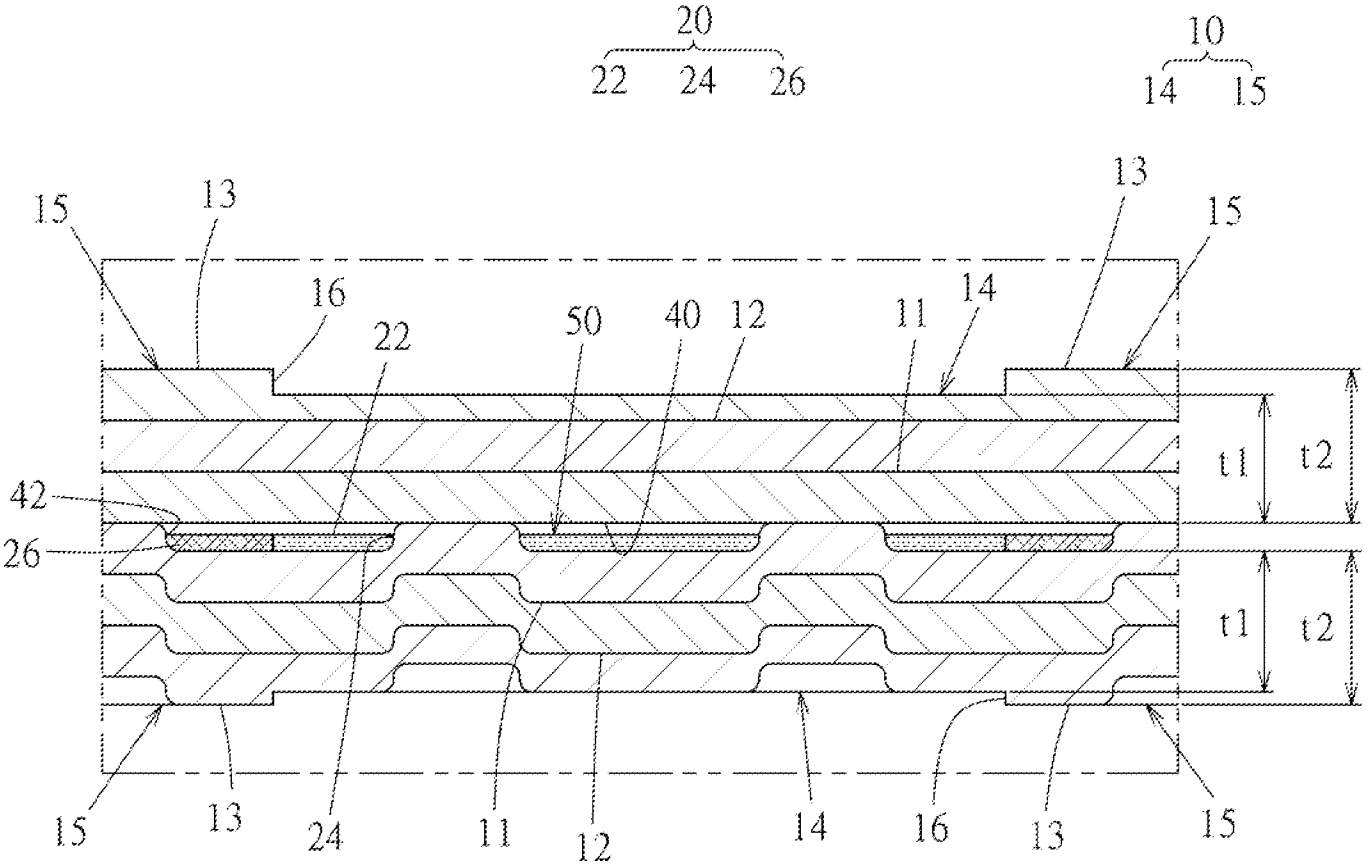
FIG. 9 is a partially enlarged cross-sectional view of Embodiment 3 of the present invention.

As shown in FIG. 9, Embodiment 3 differs from Embodiment 1 primarily in that each flexible enclosure 10 comprises a first metal film 11, a polymer film 12, and a second metal film 13, wherein each of the second metal films 13 covers a side of each of the polymer films 12 in a direction away from each of the first metal films 11, and each of the second metal films 13 constitutes a side of each of the recesses 16 facing the chamber 40 and two opposite sides of each of the recesses 16 of each of the flexible enclosures 10 in the length direction.

Figure 10:
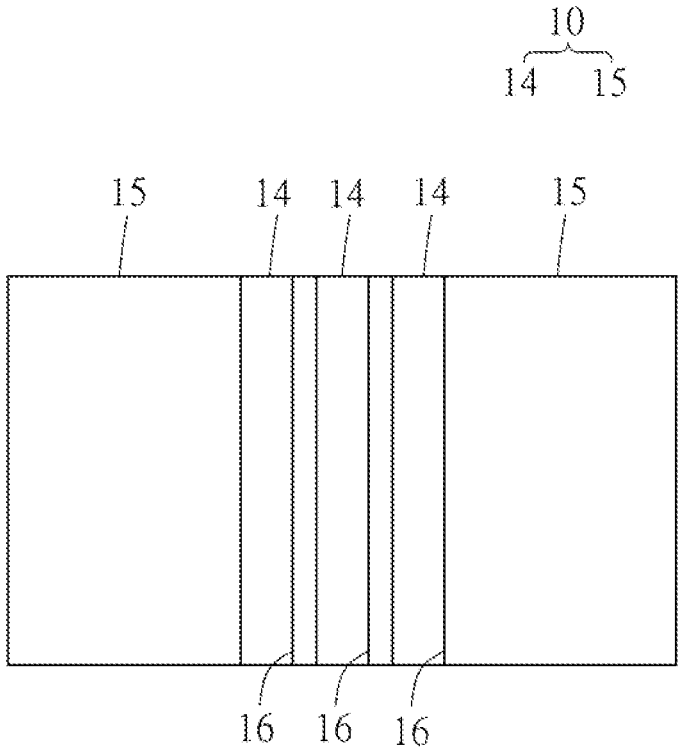
FIG. 10 is a top view of Embodiment 4 of the present invention.

As shown in FIG. 10, Embodiment 4 differs from Embodiment 1 primarily in that each of the flexible enclosures 10 is formed with multiple recesses 16 spaced apart in the length direction, whereby each of the flexible enclosures 10 is formed with multiple flexible sections 14 spaced apart between each of the extensions 15.

Figure 11:
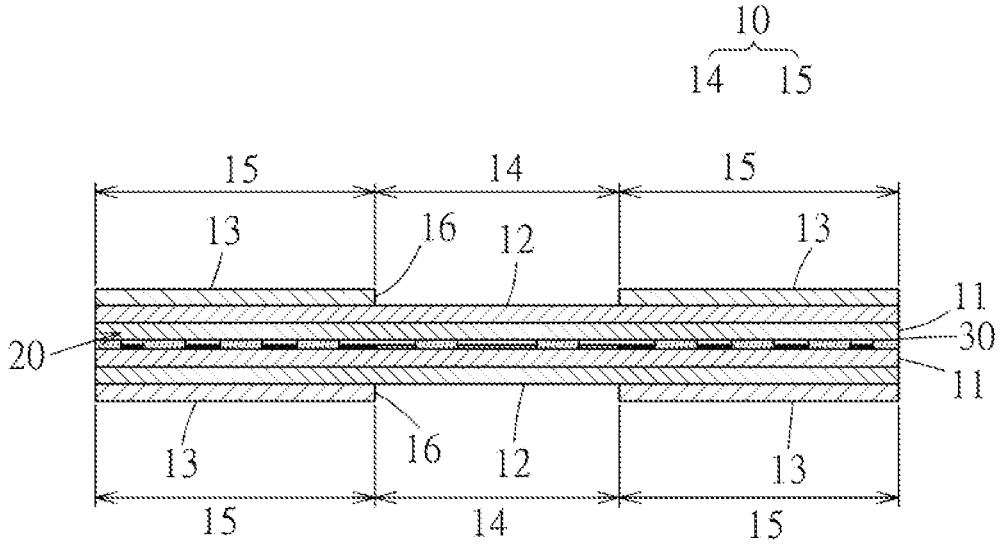
FIG. 11 is a partially enlarged cross-sectional view of Embodiment 5 of the present invention.

As shown in FIG. 11, Embodiment 5 differs from Embodiment 1 primarily in that each of the first metal films 11 is formed into a planar shape on the side facing the chamber 40, and each of the copper rods 24 is optionally arranged between each of the first metal films 11, and both ends of each copper rod 24 are abutted against and connected to each of the first metal films 11, respectively.

In Embodiment 5, each of the copper rods 24 may optionally be bonded to each of the first metal films 11 while the sealing edge structure 30 is being formed by low-temperature hot-melting or sintering.

I claim:

1. A flexible vapor chamber, comprising two flexible enclosures and a wick structure, wherein each of the flexible enclosures is a flat and thin structure having a width and a length; each of the flexible enclosures is opposed to each other in a thickness direction, and each of the flexible enclosures is combined to form a sealing edge structure, and a chamber is formed between each of the flexible enclosures and the sealing edge structure; the interior of the chamber accommodates a working fluid, which is used to absorb and dissipate heat, and the wick structure is disposed in the chamber and divides the chamber to form multiple wick spaces which are used to direct the flow direction of the working fluid;

each of the flexible enclosures is a layered structure that is flexibly bent in the thickness direction, and each of the flexible enclosures comprises a first metal film, a flexible polymer film, and two second metal films, wherein the first metal film is positioned on a side of each of the flexible enclosures facing the chamber in the thickness direction, and each of the second metal films is positioned on a side of each of the flexible enclosures away from the chamber in the thickness direction, and the polymer film is positioned between the first metal film and the second metal film;

the flexible enclosure is formed with a flexible section and two extensions along a length direction, wherein each of the flexible sections is located between each of the extensions that constitute each of the flexible enclosures, and each of the flexible sections extends to opposite sides of each of the flexible enclosures in a width direction; the thickness of each of the flexible sections is thinner than the thickness of its adjacent connected extensions, whereby each of the flexible enclosures is flexibly bent in the thickness direction;

the configuration density of the wick structure at the part corresponding to each of the flexible sections is smaller than the configuration density at the part corresponding to each of the extensions.

2. The flexible vapor chamber according to claim 1, wherein each of the wick spaces is a first wick space and a second wick space;

the wick structure comprises multiple copper wires, multiple copper rods, and multiple meshes, wherein each of the copper wires is axially parallel to each other and arranged in bundles, and each of the copper wires extends axially from the flexible section corresponding to the chamber to the extensions corresponding to the chamber on both sides, and the multiple first wick spaces are formed between each of those adjacent copper wires, respective; at least one first metal films is formed on a side facing the chamber with each of the copper rods, and each of the meshes is configured between each of the adjacent copper rods, thereby forming the second wick spaces;

along the thickness direction of each of the flexible enclosures, the configuration density of each of the copper rods at the part corresponding to each of the flexible sections is smaller than the configuration density at the part corresponding to each of the extensions, and each of the meshes is configured at the part corresponding to each of the extensions.

3. The flexible vapor chamber according to claim 1, wherein each of the flexible enclosures forms a recess on a side of the flexible enclosure that is away from the chamber in the thickness direction; within each of these flexible enclosures, each of the flexible sections constitutes a side of the recess facing the chamber, and each of the extensions is formed on the opposite sides of the recess in the length direction of each flexible enclosure, and each of the recesses extends across the opposite sides of each flexible enclosure in the width direction.

4. The flexible vapor chamber according to claim 3, wherein each of the flexible enclosures is configured with two of the second metal films spaced apart in the length direction, each of the second metal films constituting two opposite sides of each of the recesses.

5. The flexible vapor chamber according to claim 3, wherein each of the polymer films constitutes a side of each of the recesses facing the chamber.

6. The flexible vapor chamber according to claim 4, wherein each of the recesses enters each of the polymer films in the direction of the chamber.

7. The flexible vapor chamber according to claim 3, wherein each of the second metal films constitutes a side of each of the recesses facing the chamber and two opposite sides of each of the recesses of each of the flexible enclosures in the length direction.

8. The flexible vapor chamber according to claim 1, wherein each of the flexible enclosures is formed with multiple flexible sections spaced apart between each of the extensions.

* * * * *